US007674115B2

(12) United States Patent
Midorikawa

(10) Patent No.: US 7,674,115 B2
(45) Date of Patent: Mar. 9, 2010

(54) ELECTRICAL CONNECTOR

(75) Inventor: Kazuya Midorikawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/219,575

(22) Filed: Jul. 24, 2008

(65) Prior Publication Data

US 2009/0029572 A1 Jan. 29, 2009

(30) Foreign Application Priority Data

Jul. 25, 2007 (JP) ..... 2007-192744

(51) Int. Cl.
*H01R 12/00* (2006.01)

(52) U.S. Cl. ..... 439/74

(58) Field of Classification Search ..... 439/74, 439/856–858

See application file for complete search history.

(56) References Cited

U.S. PATENT DOCUMENTS

| | | | | |
|---|---|---|---|---|
| 5,885,092 | A * | 3/1999 | Ito et al. | 439/74 |
| 6,394,833 | B1 * | 5/2002 | Bulmer et al. | 439/393 |
| 6,846,187 | B2 * | 1/2005 | Yu | 439/74 |
| 7,172,433 | B2 * | 2/2007 | Tsai | 439/74 |
| 7,278,861 | B2 * | 10/2007 | Kishi et al. | 439/74 |
| 7,320,606 | B2 * | 1/2008 | Midorikawa | 439/74 |
| 7,390,196 | B2 * | 6/2008 | Sasaki | 439/74 |
| 7,413,444 | B2 * | 8/2008 | Wang | 439/74 |
| 2001/0027036 | A1 * | 10/2001 | Goto | 439/74 |
| 2004/0142586 | A1 * | 7/2004 | Yu | 439/74 |
| 2004/0171285 | A1 * | 9/2004 | Okura | 439/74 |
| 2005/0009383 | A1 * | 1/2005 | Okura et al. | 439/74 |
| 2006/0199403 | A1 * | 9/2006 | Tsai | 439/74 |
| 2007/0020967 | A1 * | 1/2007 | Midorikawa | 439/74 |
| 2007/0218716 | A1 * | 9/2007 | Liu | 439/74 |

FOREIGN PATENT DOCUMENTS

| | | |
|---|---|---|
| JP | 9-259979 | 10/1997 |
| JP | 2001-057273 A | 2/2001 |
| JP | 3108400 U | 4/2005 |
| SU | S60-57083 U | 4/1985 |

* cited by examiner

*Primary Examiner*—Gary F. Paumen
(74) *Attorney, Agent, or Firm*—Kubotera & Associates, LLC

(57) ABSTRACT

An electrical connector for a circuit board has a housing and a receiving recess portion for receiving a mating connector. A plurality of terminals is arranged in a terminal groove. The terminal has an attachment portion fitted to the housing and an elastic portion extending along the receiving recess portion. The elastic portion has a suspended arm portion, a bottom arm portion, and a rising arm portion. The rising arm portion has a contact portion on an upper edge position and an abutting portion below the contact portion.

8 Claims, 7 Drawing Sheets

ELECTRICAL CONNECTOR

BACKGROUND OF THE INVENTION AND RELATED ART STATEMENT

The present invention relates to an electrical connector for a circuit board.

A conventional electrical connector for a circuit board has been disclosed in Patent Reference. In the electrical connector disclosed in Patent Reference, a bottom wall of a housing that holds a terminal passes through the housing to open downward. Further, the terminal is attached to the housing through the opening from below.

Patent Reference: Japanese Patent Publication No. 09-259979

In the electrical connector disclosed in Patent Reference, a receiving recess portion is formed in the housing between a sidewall and an opposed wall thereof. The receiving recess portion receives a mating connector. As described above, the receiving recess portion passes through the bottom wall to open downward.

The terminal is formed of a metal sheet maintaining a flat plate surface. The terminal has an attachment arm portion, a rising arm portion, and an upright arm portion. The attachment arm portion is pressed fit to an attachment hole that is formed in the sidewall of the housing from below. The rising arm portion is provided to be along the opposed wall of the receiving recess portion. The upright arm portion is formed along an inner wall face of the sidewall between the attachment arm portion and the rising arm portion.

The rising arm portion has a contact portion having a protrusion shape on an upper edge of an inner side edge thereof. The upright arm portion has a locking portion having a protrusion shape on an upper edge of an opposing inner side edge thereof. Further, a mating terminal that is attached to a supporting wall of a housing of the mating connector is received inside of the receiving recess portion and held between the contact portion and the locking portion. That is, the contact portion elastically contacts the mating terminal.

The locking portion enters a locking recess portion of the mating terminal. Accordingly, the mating connector is prevented from coming off. A locking protruding portion is formed on the upper edge of the opposed wall. The locking protruding portion is formed to protrude to cover the contact portion as an eave. The lower surface of the locking protruding portion is adjacent to face an upper edge of the contact portion.

When the mating connector is pulled out upward from the connector for a circuit board, the contact portion is pulled upward due to a contact pressure with the mating terminal. That is, the terminal is elastically deformed, so that the rising arm portion having the contact portion on the upper edge thereof is lifted upward. This tendency is especially remarkable when the mating connector is pulled out in an inclined state instead of being pulled out vertically upward. If no force is generated to stall the terminal, the terminal may come off or may be plastically deformed.

In the conventional connector disclosed in Patent Reference, the rising arm portion has the contact portion on the upper edge thereof. When the mating connector is pulled out to lift the rising arm portion upward, the contact portion immediately becomes adjacent to the lower surface of the locking protruding portion to prevent further lifting. Accordingly, the terminal is prevented form coming off.

In the conventional connector disclosed in Patent Reference, the locking protruding portion is provided. Accordingly, it is difficult to attach the terminal to the housing from above. Accordingly, as described above, the terminal is attached from below. As a result, the receiving recess portion opens downward. Accordingly, the terminal is attached from the opening of the housing that is formed to pass through the bottom wall. Thus, the housing regulates an upward movement of the attachment arm portion of the terminal.

With the structure mentioned above, it is possible to prevent the terminal from coming off when the mating connector is pulled out. That is, the terminal is effectively prevented from coming off due to the action of the locking protruding portion on the contact portion and the action of the housing on the attachment arm portion. However, a force that the contact portion receives from the locking protruding portion becomes a compressive force to the rise portion of the terminal. Accordingly, the rising arm portion may be buckled or plastically deformed.

Further, in Patent Reference, the bottom wall opens to pass through and the bottom arm portion that connects the rising arm portion and the upright arm portion is situated in the opening to directly face a circuit board. A gap is extremely small, and the bottom arm portion of the terminal may contact with an unnecessary portion due to a distortion caused by an influence factor such as heat of the circuit board or the like, thereby making contact unstable and not electrically preferable.

In view of the problems described above, an objective of the present invention is to provide an electrical connector for a circuit board in which a housing has a bottom wall so that a bottom arm portion of a terminal is not exposed downward. Accordingly, the terminal is not plastically deformed or does not come off due to an upward lifting of the terminal when a mating connector is pulled out even when the terminal is attached from above.

Further objects and advantages of the invention will be apparent from the following description of the invention.

SUMMARY OF THE INVENTION

In order to attain the objects described above, an electrical connector for a circuit board has a receiving recess portion for receiving a mating connector. The receiving recess portion has a bottom wall surface between an inner wall surface and an opposed wall surface of a sidewall of a housing. The housing is arranged on a circuit board. A plurality of terminals is arranged in a longitudinal direction of the inner wall face of the sidewall. The terminals are stored in a terminal groove that is formed in the inner wall surface and the opposed wall surface of the sidewall.

According to a first aspect of the present invention, the terminal has an attachment portion and an elastic portion. The attachment portion is fitted to the sidewall of the housing from above. The elastic portion is formed to continue from the attachment portion, and extends along an inner surface of the receiving recess portion. The elastic portion has a suspended arm portion, a bottom arm portion, and a rising arm portion. The suspended arm portion is formed to continue from the attachment portion along the inner wall face of the sidewall. The bottom arm portion is formed to be along the bottom wall surface. The rising arm portion is formed to be along an opposing inner wall surface.

Further, the elastic portion has an approximate U-character shape that is flexible. The elastic portion is elastic at least in the bottom arm portion and the rising arm portion. The rising arm portion has a contact portion and an abutting portion. The rising arm portion has the contact portion on an upper edge position of a side edge portion that faces an inside of the receiving recess portion. The rising arm portion has the abutting portion below the contact portion.

In the first aspect of the present invention, when the mating connector is pulled out, especially when the mating connector is obliquely pulled out, a terminal portion of the mating connector first abuts against the adjacent potion of the terminal of the connector. Accordingly, the terminal opens through elastic deformation of the rising arm portion, so that the mating connector is pulled out with ease.

When the mating connector is further pulled out, the abutting portion immediately slides along a lower edge curved portion of the mating terminal to come off from a range of the mating terminal, so that the abutting portion does not abut against the terminal portion of the mating terminal. Accordingly, the terminal does not receive an excessive force from the mating connector when the mating connector is forcibly pulled out, thereby preventing the terminal from coming off or being deformed.

In the first aspect of the present invention, it is preferred that the rising arm portion extends to be inclined upward toward an inside of the receiving recess portion, and the abutting portion protrudes with respect to the terminal of the mating connector for an amount slightly less than that of the contact portion. Thus, when the mating connector is pulled out and consequently fitted in a regular position in a straight direction without an inclination, the mating connector contacts with only the contact portion without contacting the abutting portion, thereby reducing a resistance force upon pulling out or insertion. Further, it is possible to secure a large effective engaging length, thereby improving reliability of contact.

In the first aspect of the present invention, it is preferred that the abutting portion be positioned to be adjacent to the contact portion. When the abutting portion becomes adjacent to the mating connector, it is possible to obtain a large arm length of the rising arm portion upon elastically bending in the abutting portion. Accordingly, it is possible to increase a bending moment based on a force from the mating connector, thereby making it easy to open the terminal.

According to a second aspect of the present invention, the terminal has the attachment portion and the elastic portion. The attachment portion is fitted to the sidewall of the housing from above. The elastic portion is formed to continue from the attachment portion and extends along the inner surface of the receiving recess portion. The elastic portion has the suspended arm portion, the bottom arm portion, and the rising arm portion. The suspended arm portion is formed to continue from the attachment portion along the inner wall face of the sidewall. The bottom arm portion is formed to be along the bottom wall surface. The rising arm portion is formed to be along the opposing inner wall surface.

Further, the elastic portion has an approximate U-character shape that is flexible. The elastic portion is elastic at least in the bottom arm portion and the rising arm portion. The rising arm portion has the contact portion on an upper edge position of a side edge portion that faces an inside of the receiving recess portion. Further, a transfer portion from the bottom arm portion to the rising arm portion is formed to be a curved arm portion.

Moreover, a locking protruding portion is formed to protrude from the curved arm portion. The locking protruding portion is adjacent to or contacts with the opposed wall surface toward a lower edge area of the opposed wall surface from the curved arm portion.

In the second aspect of the present invention, when the mating connector is pulled out, especially when the mating connector is obliquely pulled out, the rising arm portion and the bottom arm portion receive the force from the mating connector to be bent. Accordingly, the locking protruding portion contacts with the opposed wall surface so as to increase a contact pressure. As a result, the rising arm portion is stalled to resist the pulling out force of the mating connector so as to prevent the terminal from being further lifted. A pull force acts to the rising arm portion and a buckling does not occur.

As described above, according to the first aspect of the present invention, the abutting portion is provided below the contact portion of the terminal. The abutting portion is pressed by the mating connector to widen the rising arm portion, which enables the mating connector to be pulled out with ease. As the pulling out proceeds, the abutting portion comes off along the lower edge curved portion of the mating connector, which does not prevent the mating connector from being pulling out. That is, in the first aspect of the present invention, the mating connector may be pulled out with ease.

According to the second aspect of the present invention, the locking protruding portion is provided in the curved arm portion of the transfer portion between the rising arm portion and the bottom arm portion of the terminal. When the mating connector is pulled out, especially when the mating connector is obliquely pulled out, the locking protruding portion is locked with the opposed wall surface of the housing. Accordingly, the terminal is stalled to resist the pulling out so as to prevent the terminal from coming off or being plastically deformed (a buckling or the like).

In the first aspect and the second aspect of the present invention, when the mating connector is pulled out, the terminal is lifted upward and the terminal is prevented from being plastically deformed or coming off.

DETAILED DESCRIPTION OF PREFERRED EMBODIMENTS

Hereunder, embodiments of the present invention will be explained with reference to the accompanying drawings.

First Embodiment

Figure 1:
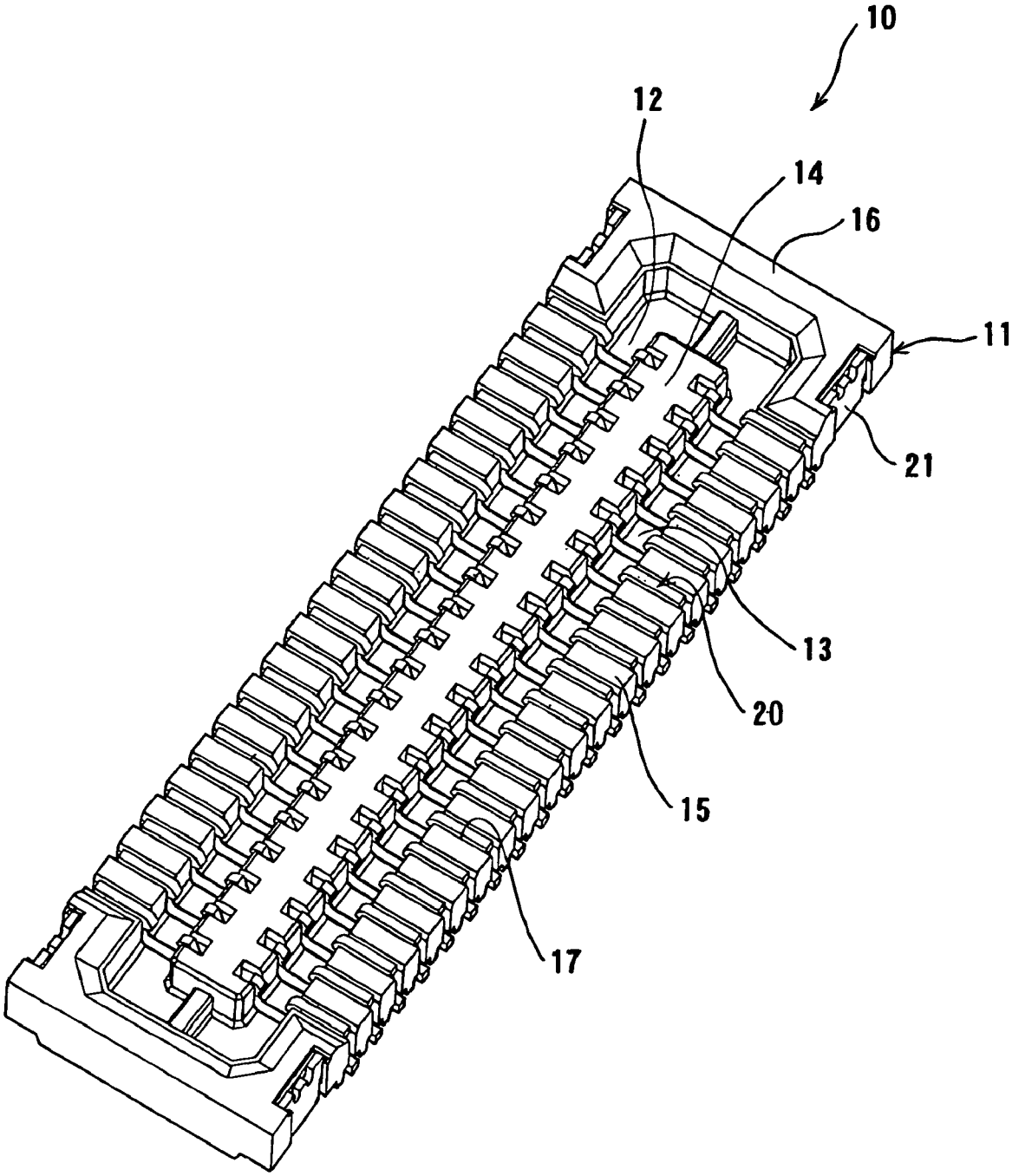
FIG. 1 is a perspective view showing a connector according to a first embodiment of the present invention.
Figure 2:
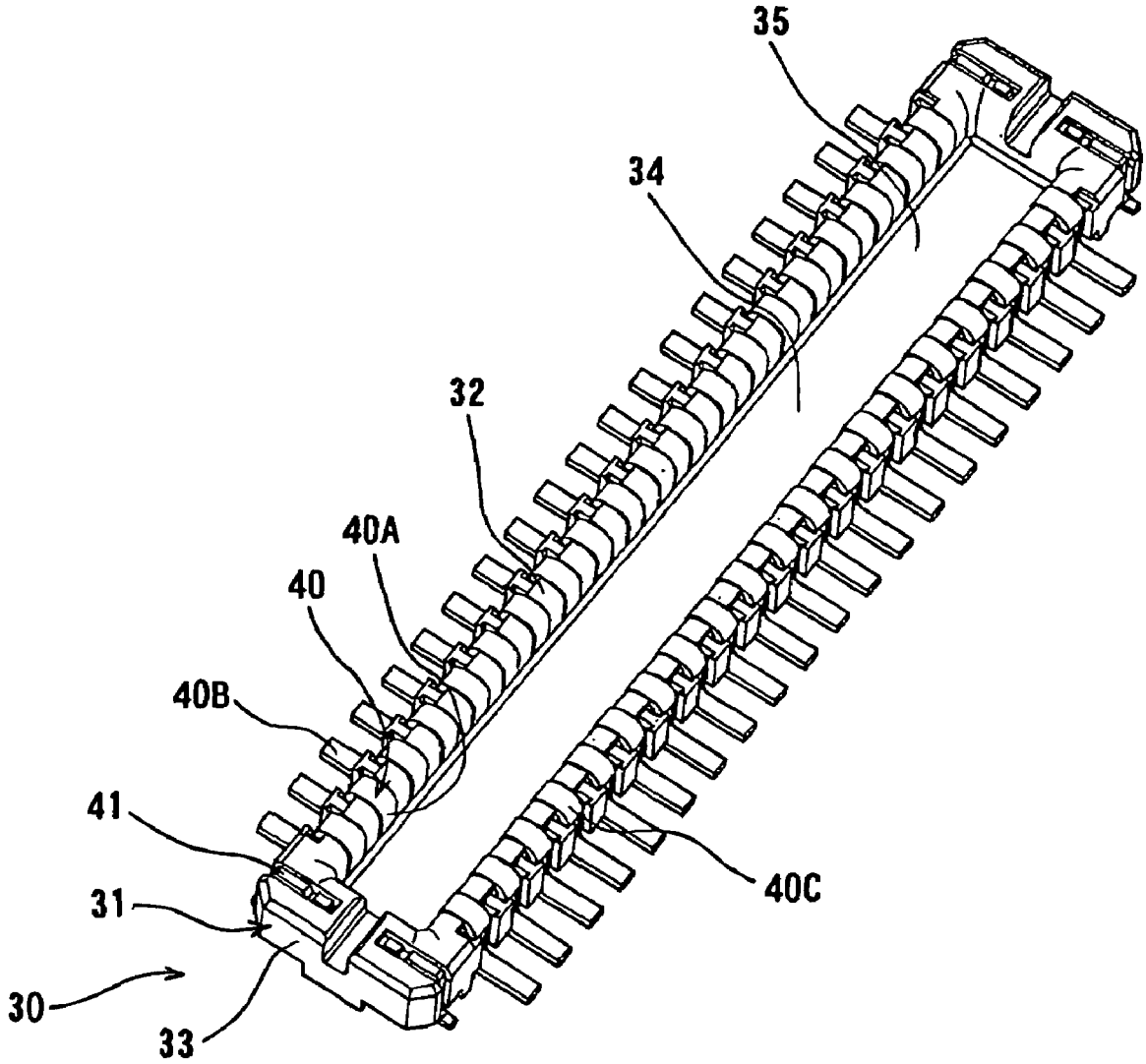
FIG. 2 is a perspective view showing a mating connector to be fitted to the connector shown in FIG. 1 according to the first embodiment of the present invention.

A first embodiment of the present invention will be explained. FIG. 1 is a perspective view showing a connector 10 according to the first embodiment of the present invention. FIG. 2 is a perspective view showing a mating connector 30 to be fitted to the connector 10 shown in FIG. 1 according to the first embodiment of the present invention. In FIGS. 1 and 2, the connector and the mating connector are viewed from a side in which the connector and the mating connector are fitted together.

As shown in FIG. 1, the connector 10 for a circuit board has a rectangular flat shape and is made relatively thin. Further, the connector 10 is attached to a circuit board on a bottom surface (not shown in FIG. 1) thereof. A receiving recess portion 12 is formed in a housing 11 of the connector 10. The receiving recess portion 12 opens upward and receives the mating connector 30. The receiving recess portion 12 is formed to extend in a longitudinal direction of the housing 11 in a center portion of the housing 11.

In the embodiment, the receiving recess portion 12 is formed to have an annular shape in a plan view around a center protruding portion 14. The center protruding portion 14 having an island shape protrudes from a bottom wall 13. The receiving recess portion 12 has sidewalls 15 and edge walls 16. Each of the sidewalls 15 extends in the longitudinal direction. Each of the edge walls 16 connects the sidewalls 15 on both sides thereof at end portions thereof.

The receiving recess portion 12 is symmetrically formed on both sides of the center protruding portion 14. The receiving recess portion 12 will be explained in more detail later. Terminals 20 and fixed metal fittings 21 are attached to the sidewall 15 of the housing 11. One side of the terminal 20 extends along an outer wall surface of the sidewall 15. The other side of the terminal 20 extends along an inner surface of the receiving recess portion 12. The connector 10 along with the terminal 20 will be explained later.

In the embodiment, the mating connector 30 is fitted to the connector 10. As shown in FIG. 2, a housing 31 of the mating connector 30 has sidewalls 32 on both sides thereof, edge walls 33 on both ends thereof, and a bottom wall 34. The sidewalls 32, the edge walls 33, and the bottom wall 34 form a receiving recess portion 35.

The receiving recess portion 35 forms a space to receive the center protruding portion 14 of the connector 10. Further, the sidewalls 32 and the edge walls 33 are received in the receiving recess portion 12 of the connector 10. The terminals 40 and the fixed metal fittings 41 are attached to each of the sidewalls 32. The mating connector 30 along with the terminal 40 will be explained later.

A plurality of the terminals 20 is attached to and arranged on the sidewall 15 of the connector 10 at a specific interval in a longitudinal direction of the connector 10.

Figure 3:
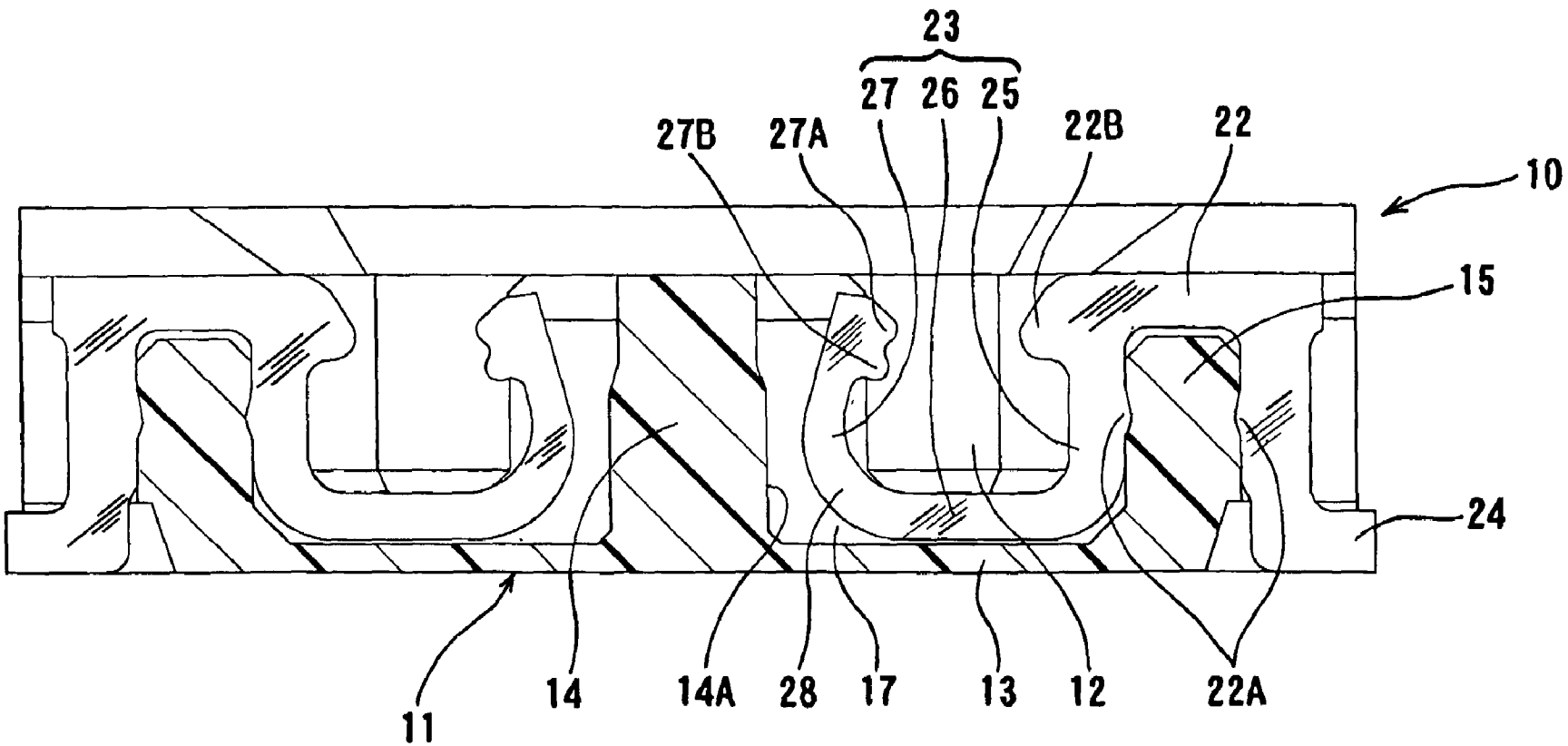
FIG. 3 is a sectional view showing the connector taken along a position of a terminal thereof according to the first embodiment of the present invention.

FIG. 3 is a sectional view showing the connector 10 taken along a position of the terminal 20 thereof according to the first embodiment of the present invention. As shown in FIG. 3, the terminal 20 is formed of a metal sheet having a flat plate surface that is parallel to a sheet surface shown in FIG. 3 while maintaining the flat plate surface.

In the embodiment, the terminal 20 has an attachment portion 22, an elastic portion 23, and a connecting portion 24. The attachment portion 22 is attached to the sidewall 15. The elastic portion 23 extends from the attachment potion 22 to an inside of the receiving recess portion 12. The connecting portion 24 is bent from a lower portion of the sidewall 15 on an outer wall surface thereof to protrude outwardly.

The attachment portion 22 having an inverted U-character shape is attached to the sidewall 15 from above. Locking protruding portions 22A are formed on inner edges of the attachment portion 22. The locking protruding portion 22A bites into a surface of the sidewall 15 to fix the attachment portion 22.

A locking portion 22B is provided in an inner edge of a top portion of the attachment portion 22. The locking portion 22B protrudes inward of the receiving recess portion 12. The locking portion 22B engages with a corresponding locking recess portion of a mating terminal of the mating connector 30 to provide a locking mechanism. Further, the locking portion 22B contacts with the mating terminal. Accordingly, the locking portion 22B functions as a contact portion electrically.

The elastic portion 23 is situated inside of the receiving recess portion 12. The elastic portion 23 has a suspended arm portion 25, a bottom arm portion 26, and a rising arm portion 27. The suspended arm portion 25 is suspended along an inner wall face of the sidewall 15 from near the locking protruding portion 22A of the attachment portion 22 to extend. The bottom arm portion 26 extends along the bottom wall 13.

An opposing inner wall surface 14A of the center protruding portion 14 having an island shape faces the inner wall face of the sidewall 15. The rising arm portion 27 extends along the opposing inner wall surface 14A. The rising arm portion 27 extends upward while inclined toward an inner portion of the receiving recess portion 12.

In the embodiment, the elastic portion 23 is stored in a terminal groove. The terminal groove is formed in the inner surface of the receiving recess portion 12 of the housing 11 (explained later). The elastic portion 23 is elastic so as to be flexible within a surface that is parallel to a sheet surface at least in the bottom arm portion 26 and the rising arm portion 27.

An inner edge of an upper edge portion of the rising arm portion 27 has a contact portion 27A having a protrusion shape and an abutting portion 27B having a protrusion shape. The abutting portion 27B is situated immediately below the contact portion 27A. The abutting portion 27B protrudes with respect to the mating terminal of the mating connector 30 slightly less than the contact portion 27A does. The contact portion 27A faces the locking portion 22B in a transverse direction. The bottom arm portion 26 and the rising arm portion 27 are connected through a curved arm portion 28. It should be noted that the contact portion 27A and the abutting portion 27B may be connected so as to form one protruding portion.

The connecting portion 24 is bent to protrude outward from a lower edge of a portion in which the attachment portion 22 droops along an outer surface of the sidewall 15. The lower edge of the connecting portion 24 is substantially flush with a lower surface of the housing 11. When the connector 10 is arranged on the circuit board, the connecting portion 24 is adjacent to a corresponding circuit portion to be soldered there.

As shown in FIG. 1, the fixed metal fitting 21 is provided to be adjacent to the terminal 20 that is situated in an end portion in an arrangement direction and outside of an arrangement range of the terminals 20. The fixed metal fitting 21 is made of a metal sheet. A lower edge of the fixed metal fitting 21 is soldered with a corresponding portion of the circuit board.

As shown in FIGS. 1 and 3, when the housing 11 of the connector 10 is cut along a position of the terminal 20, the terminal groove 17 is formed in an inner surface of the receiving recess portion 12 to store the elastic portion 23 of the terminal 20. The elastic portion 23 has a U-character shape. The elastic portion 23 is stored in the terminal groove 17. The contact portion 27A and the abutting portion 27B protrude from the terminal groove 17 in a free state. The contact portion 27A and the abutting portion 27B have protrusion shapes.

The terminal 40 is attached to the sidewall 32 of the housing 31 of the mating connector 30 at a position that corresponds to the terminal 20 of the connector 10. While the terminal 20 of the connector 10 is made to maintain a flat surface of a metal sheet, the terminal 40 of the mating connector 30 is made through bending a metal plate in a band shape toward a plate thickness direction thereof. Accordingly, the terminal 40 of the mating connector 30 has a large width that can contact with the terminal 20 of the connector 10.

In the embodiment, the terminal 40 has a contact portion 40A, an outer plate portion 40C, and a connecting portion 40B. The contact portion 40A extends along an inner surface of the sidewall 32 of the housing 31. The outer plate portion 40C extends along an outer surface of the sidewall 32 outside of the sidewall 32. The connecting portion 40B is overhung from the outer plate portion 40C toward a side. A locking recess portion 40C-1 is recessed from an outer surface of the outer plate portion 40C. Further, similar to the connecting portion 24 of the terminal 20 of the connector 10, the connecting portion 40B overhangs to be soldered to the circuit board.

As shown in FIG. 2, the fixed metal fitting 41 is provided to be adjacent to the terminal 40 on each end in an arrangement direction outside of the arrangement range of the terminals 40. Similar to the fixed metal fitting 21 of the connector 10, the fixed metal fitting 41 is soldered to a corresponding portion of the circuit board.

Figure 4:
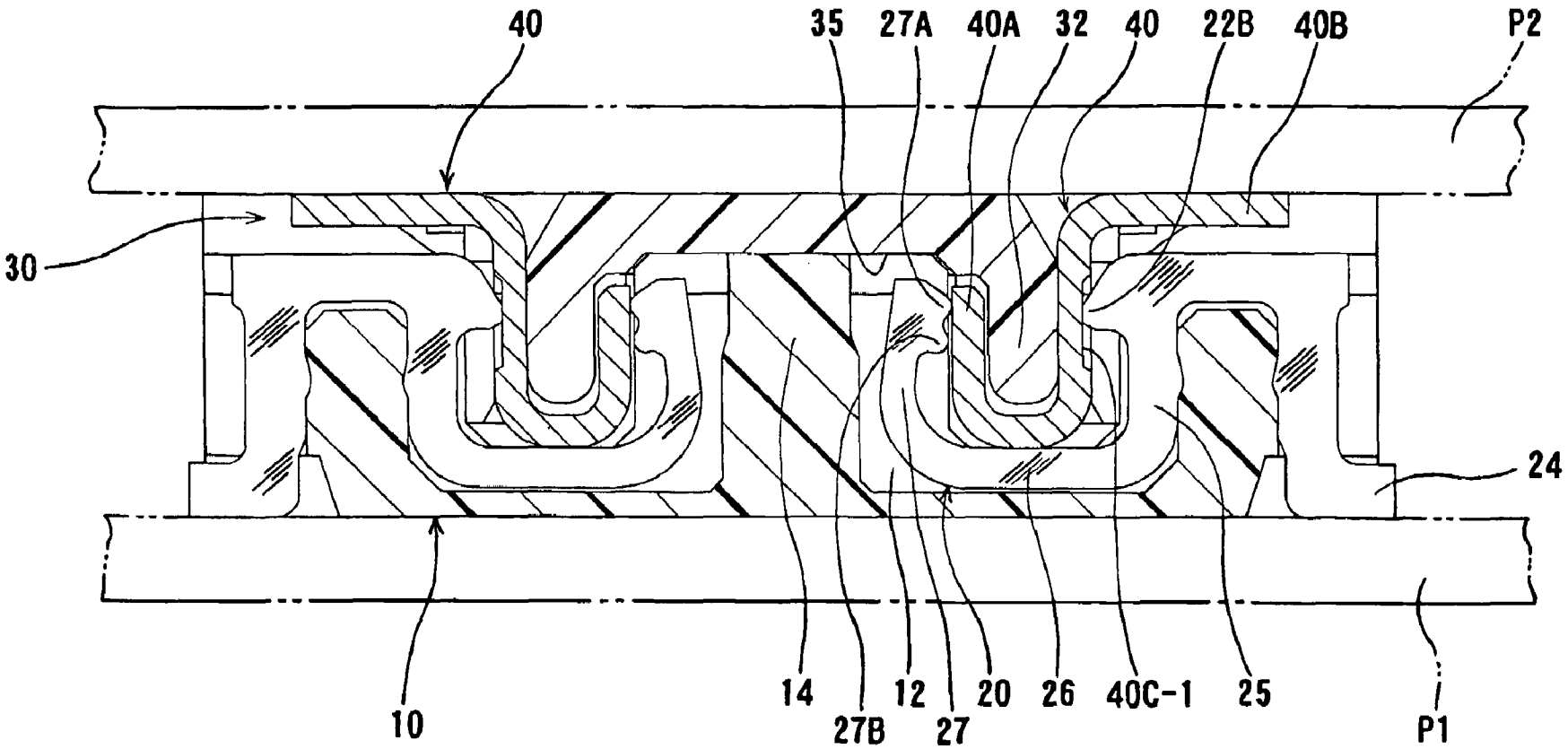
FIG. 4 is a sectional view showing the connector and the mating connector in a fitted state according to the first embodiment of the present invention.
Figure 5:
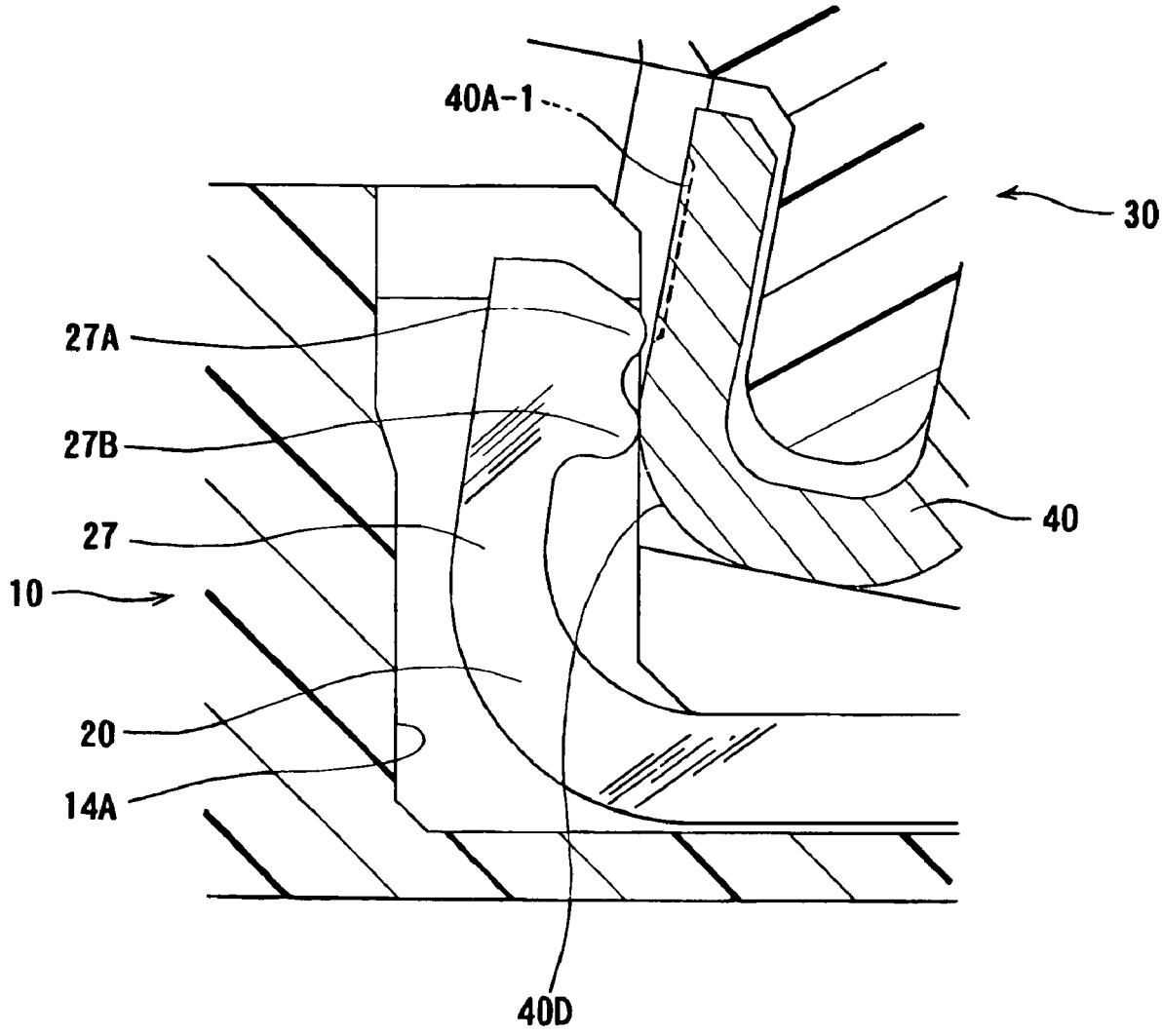
FIG. 5 is an enlarged sectional view showing the connector and the mating connector in a state that the mating connector is pulled out in an inclined state according to the first embodiment of the present invention.

FIG. 4 is a sectional view showing the connector 10 and the mating connector 30 in a fitted state according to the first embodiment of the present invention. FIG. 5 is an enlarged sectional view showing the connector 10 and the mating connector 30 in a state that the mating connector 30 is pulled out in an inclined state according to the first embodiment of the present invention.

The connector 10 and the mating connector 30 according to the embodiment are used as follows. First, the connector 10 and the mating connector 30 are connected to a circuit board P1 and a circuit board P2, respectively. Further, the connector 10 and the mating connector 30 are fitted together while the circuit boards P1 and P2 are parallel to each other as shown in FIG. 4.

Then, the sidewall 32 is stored inside of the receiving recess portion 12 of the connector 10, so that the connector 10 and the mating connector 30 are fitted together. The terminal 40 of the mating connector 30 is attached to the sidewall 32. Similarly, the center protruding portion 14 of the connector 10 is stored inside of the receiving recess portion 35 of the mating connector 30, so that the connector 10 and the mating connector 30 fitted together.

When the connector 10 and the mating connector 30 are fitted together, the contact portion 27A of the terminal 20 of the connector 10 contacts the contact portion 40A of the terminal 40 of the mating connector 30 with an elastic pressure. Further, the locking portion 22B of the terminal 20 of the connector 10 enters the locking recess portion 40C-1 of the terminal 40 of the mating connector 30 to lock so as to prevent the mating connector 30 from coming off upward. While the contact portion 27A of the terminal 20 contacts the terminal 40 of the mating connector 30, the abutting portion 27B does not contact with the terminal 40, thereby forming a space therebetween.

In the embodiment, the mating connector 30 can be pulled out of the connector 10 smoothly while the circuit boards P1 and P2 are parallel to each other. In other words, the mating connector 30 is pulled out of the connector 10 smoothly when the mating connector 30 is pulled out vertically upward.

The mating connector 30 is often pulled out in the inclined state as shown in FIG. 5. As shown in FIG. 5, when the mating connector 30 is inclined, the lower edge portion of the terminal 40 of the connector 30 presses the abutting portion 27B of the terminal 20 of the connector 10 to a transverse direction early. Accordingly, the rising arm portion 27 of the terminal 20 is bent toward a left side to widen a space with the suspended arm portion 25, which enables the mating connector 30 to be pulled out upward smoothly.

As the pulling-out proceeds, the abutting portion 27B enters a range of a lower edge curved portion 40D of the terminal 40 and the rising arm portion 27 returns to a right side due to the elastic force. Further, the abutting portion 27B in the bent portion pushes the mating connector 30 upward by an upward component of a reaction force due to the adjacency. Accordingly, the pulling-out of the mating connector 30 is assisted.

In some cases, as indicated by a hidden line in FIG. 5, a locking recess portion 40A-1 may be formed in the contact portion 40A of the mating connector 30. In this case, the contact portion 27A of the terminal 20 engages with the locking recess portion 40A-1. The contact portion 27A of the terminal 20 is removed from the locking recess portion 40A-1 when the abutting portion 27B is pressed by the mating connector 30 to bend toward a left side at the beginning of an oblique pulling-out operation of the mating connector 30. Accordingly, the connector is pulled out with ease.

Second Embodiment

Figure 6:
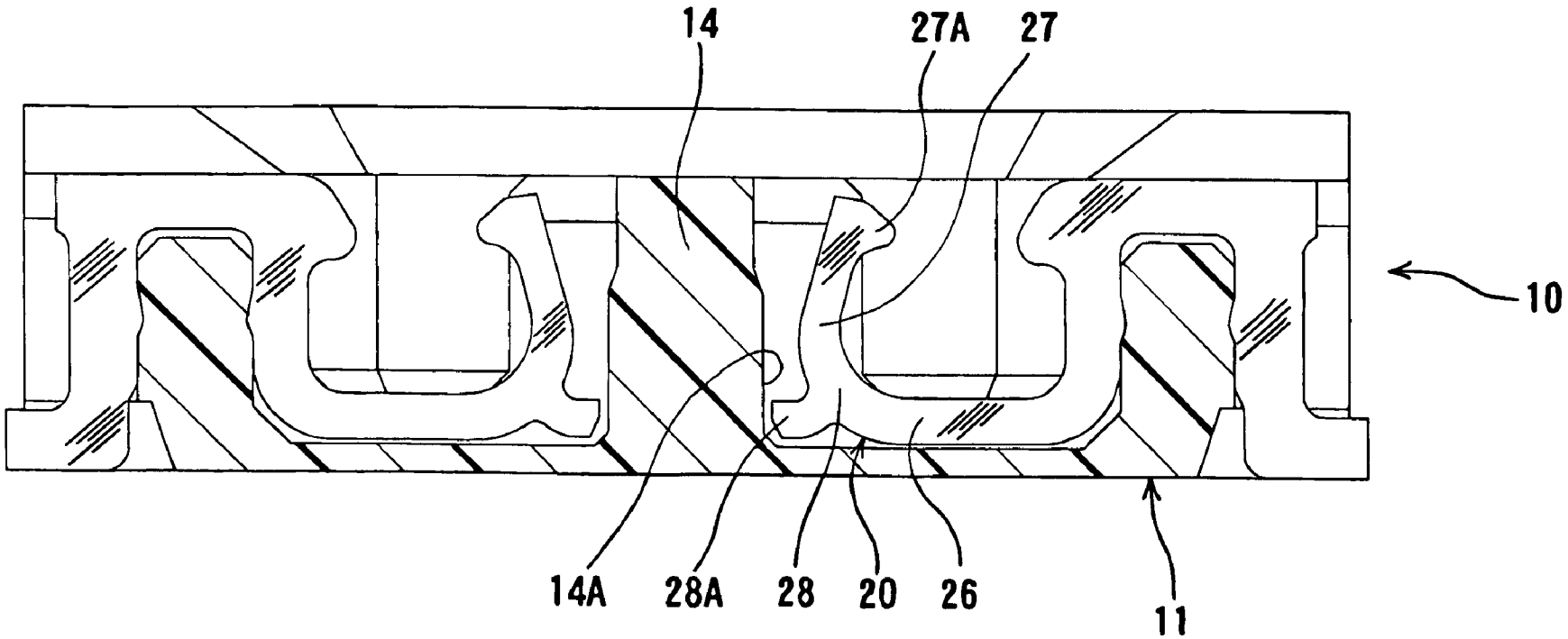
FIG. 6 is a sectional view showing a connector taken along a position of a terminal thereof according to a second embodiment of the present invention.

A second embodiment will be explained next. The present invention is not limited to the first embodiment shown in FIGS. 1 to 5. FIG. 6 is a sectional view showing the connector 10 taken along a position of the terminal 20 thereof according to the second embodiment of the present invention.

In the second embodiment shown in FIG. 6, the terminal 20 does not have the abutting portion immediately below the contact portion 27A. Instead, the terminal 20 in the embodiment shown in FIG. 6 is provided with a locking protruding portion 28A. The locking protruding portion 28A protrudes toward the opposing inner wall surface 14A from the curved arm portion 28. The curved arm portion 28 is a transfer portion between the rising arm portion 27 and the bottom arm portion 26.

When the mating connector 30 is obliquely pulled out of the connector of the embodiment as shown in FIG. 5, the contact portion 27A of the terminal 20 is pulled upward to elastically bend the bottom arm portion 26 to be lifted upward in a left portion. Accordingly, the locking protruding portion 28A is locked to the opposing inner wall surface 14A and the rising arm portion 27 is pulled downward, which prevents the terminal 20 from coming off. The contact portion 27A and the locking protruding portion 28A apply a pull force to the rising arm portion 27 in a top-to-bottom direction. Accordingly, a buckling does not occur.

Third Embodiment

Figure 7:
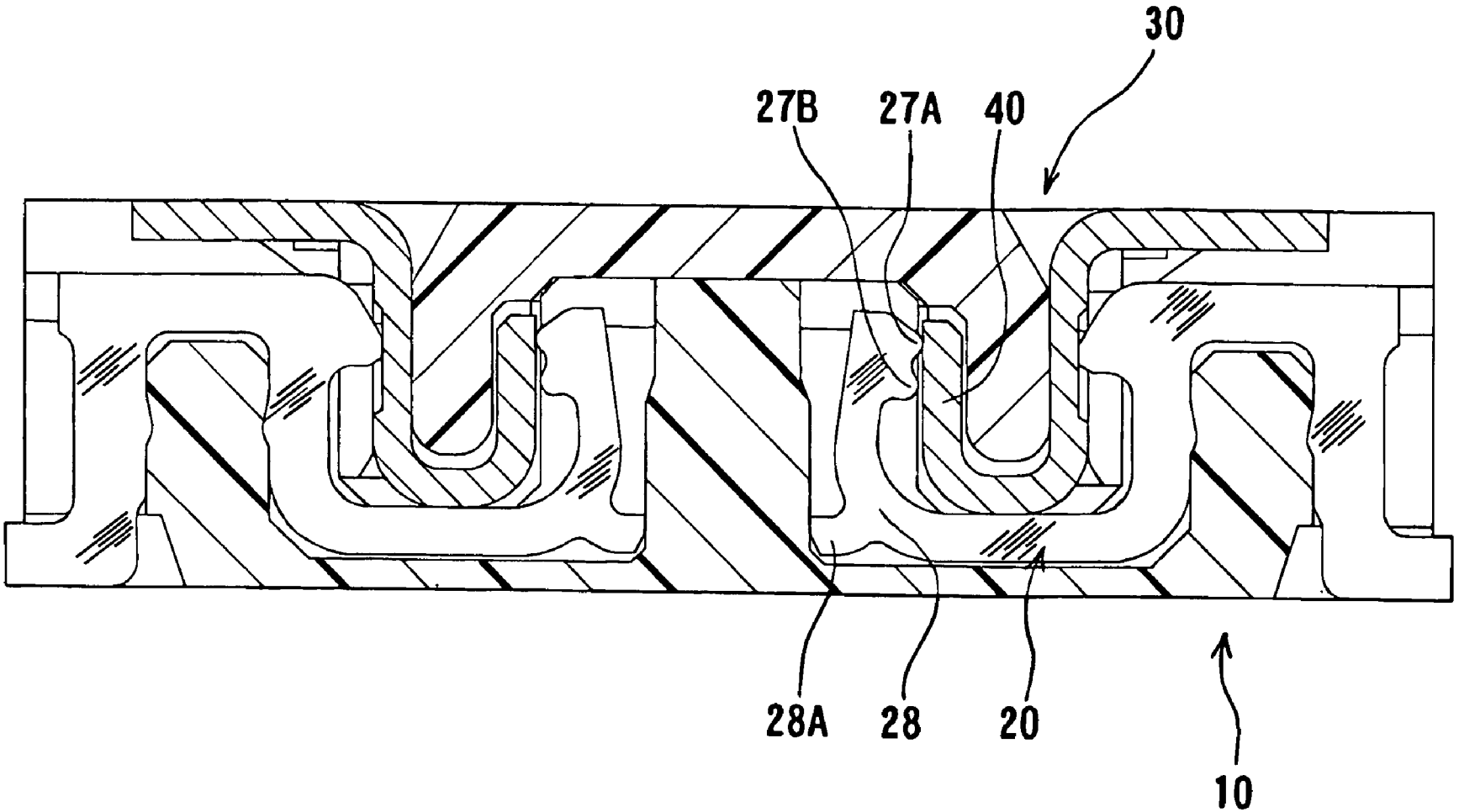
FIG. 7 is a sectional view showing a connector taken along a position of a terminal thereof according to a third embodiment of the present invention.

A third embodiment will be explained next. FIG. 7 is a sectional view showing the connector 10 taken along a position of the terminal 20 thereof according to the third embodiment of the present invention.

In the embodiment, the terminal 20 is provided with both the abutting portion 27B as shown in FIGS. 1 to 5 and the locking protruding portion 28A shown in FIG. 6. Thus, the abutting portion 27B assists the mating connector 30 to be pulled out with ease and the terminal 20 is stopped at the locking protruding portion 28A against the force of the mating connector.

The disclosure of Japanese Patent Application No. 2007-192744, filed on Jul. 25, 2007, is incorporated in the application by reference.

While the invention has been explained with reference to the specific embodiments of the invention, the explanation is illustrative and the invention is limited only by the appended claims.

What is claimed is:

1. An electrical connector to be connected to a mating connector, comprising:

a housing to be disposed on a circuit board;

a receiving recess portion formed in the housing for receiving the mating connector; and a terminal arranged in the housing, said terminal including an attachment portion fitted to the housing and an elastic portion extending from the attachment portion along the receiving recess portion, said elastic portion including a suspended arm portion, a bottom arm portion, and a rising arm portion, said rising arm portion including a contact portion at an upper portion thereof and an abutting portion at a lower portion thereof, said abutting portion protruding with respect to the mating connector for an amount slightly less than that of the contact portion so that the abutting portion does not contact with a mating terminal of the mating connector when the electrical connector is connected to the mating connector.

2. The electrical connector according to claim 1, wherein said housing includes a sidewall and an edge wall both surrounding the receiving recess portion, said attachment portion fitted to the sidewall.

3. The electrical connector according to claim 1, wherein said elastic portion is formed in a substantially U character shape.

4. The electrical connector according to claim 1, wherein said rising arm portion extends to be inclined upward toward inside the receiving recess portion.

5. The electrical connector according to claim 1, wherein said abutting portion is situated adjacent to the contact portion.

6. An electrical connector to be connected to a mating connector, comprising:

a housing to be disposed on a circuit board;

a receiving recess portion formed in the housing for receiving the mating connector, said receiving recess portion including an inner surface; and a terminal arranged in the housing, said terminal including an attachment portion fitted to the housing and an elastic portion extending from the attachment portion along the receiving recess portion, said elastic portion including a suspended arm portion, a bottom arm portion, a rising arm portion, and a curved arm portion between the bottom arm portion and the rising arm portion, said rising arm portion including a contact portion at an upper portion thereof, said curved arm portion including a locking protruding portion protruding in a direction opposite to the contact portion, said locking protruding portion being arranged to face the inner surface and not to contact with the inner surface so that the locking protruding portion engages the inner surface only when the curved arm portion deforms.

7. The electrical connector according to claim 6, wherein said housing includes a sidewall and an edge wall both surrounding the receiving recess portion, said attachment portion fitted to the sidewall.

8. The electrical connector according to claim 6, wherein said elastic portion is formed in a substantially U character shape.

* * * * *